US009425545B2

(12) United States Patent
Bedal

(10) Patent No.: US 9,425,545 B2
(45) Date of Patent: Aug. 23, 2016

(54) ELECTRICAL WIRE CONNECTOR

(71) Applicant: Heath Monroe Bedal, Elk Grove, CA (US)

(72) Inventor: Heath Monroe Bedal, Elk Grove, CA (US)

( * ) Notice: Subject to any disclaimer, the term of this patent is extended or adjusted under 35 U.S.C. 154(b) by 65 days.

(21) Appl. No.: 14/538,687

(22) Filed: Nov. 11, 2014

(65) Prior Publication Data

US 2015/0129282 A1 May 14, 2015

Related U.S. Application Data

(60) Provisional application No. 61/903,725, filed on Nov. 13, 2013.

(51) Int. Cl.

| | |
|---|---|
| ***H01R 11/03*** | (2006.01) |
| ***H01R 13/52*** | (2006.01) |
| ***H01R 4/12*** | (2006.01) |
| ***H01R 4/36*** | (2006.01) |

(52) U.S. Cl.
CPC ..... *H01R 13/5216* (2013.01); *H01R 4/12* (2013.01); *H01R 4/36* (2013.01)

(58) Field of Classification Search
CPC ..... H01R 13/5216; H01R 4/12; H01R 4/22; H01R 4/36
USPC ..... 439/431, 793, 797, 936
See application file for complete search history.

(56) References Cited

U.S. PATENT DOCUMENTS

| | | | | |
|---|---|---|---|---|
| 3,426,321 | A | 2/1969 | Peterson, Jr. | |
| 4,303,295 | A | 12/1981 | Schreder | |
| 5,137,476 | A | 8/1992 | Noble | |
| 5,756,972 | A | 5/1998 | Vranicar et al. | |
| RE37,340 | E | 8/2001 | King, Jr. | |
| 7,033,231 | B2 | 4/2006 | Lu | |
| 7,378,593 | B2 * | 5/2008 | Bukovnik | H01R 4/22 174/77 R |
| 7,892,047 | B2 * | 2/2011 | Strickland, Jr. | H01R 13/6397 439/738 |
| 9,240,649 | B2 * | 1/2016 | Battle | H01R 13/621 |
| 2009/0088032 | A1 | 4/2009 | Keeven et al. | |
| 2012/0034796 | A1 | 2/2012 | Joye | |

* cited by examiner

*Primary Examiner* — Khiem Nguyen
(74) *Attorney, Agent, or Firm* — Plager Schack LLP

(57) ABSTRACT

An electrical wire connector is configured to secure at least two electrical wires partially covered in sheaths. The electrical wire connector includes a body further comprising a cavity with a port configured to receive the at least two electrical wires twisted to form an electrical wire connection. Teeth are on a bottom surface of the electrical wire connection; wherein the teeth obstruct movement of the sheaths. A bolt, is detachably coupled to the body. Silicone fills the cavity with the at least two electrical wires. Tightening the bolt onto the sheaths into the teeth displaces some of the silicone from the cavity and creates a watertight compartment for the at least two electrical wires.

8 Claims, 3 Drawing Sheets

ELECTRICAL WIRE CONNECTOR

RELATED APPLICATION

This application claims priority to provisional patent application U.S. Ser. No. 61/903,725 filed on Nov. 13, 2013, the entire contents of which is herein incorporated by reference.

BACKGROUND

The embodiments herein relate generally to systems for connecting two electrical wires.

Prior to embodiments of the disclosed invention, when making electrical connections most connectors used a wire nut style connector designed to tighten onto the bare copper wires to hold the connection. This put unnecessary stress on the copper and frays the wire. If not connected correctly, this could cause an electrical resistance point, or could come free from the copper making a loose connection point. Other endeavors in this field include: U.S. Pat. No. 7,033,231 issued to Lu; U.S. Pat. No. 5,137,476 issued to Noble; and U.S. Pat. No. 4,303,295 issued to Schreder.

Schreder teaches a cavity configured to receive wires in an opening and then clamp down the wires with a screw. Noble teaches a tube configured to receive male wires and female wires and then tighten those down with a pair of screws. Lu teaches a cavity having an opening configured to receive wires, but does not teach an opening for male and female wires. However, none of these teach a deep cavity with silicone to ensure a watertight connection.

SUMMARY

An electrical wire connector is configured to secure at least two electrical wires partially covered in sheaths. The electrical wire connector includes a body further comprising a cavity with a port configured to receive the at least two electrical wires twisted to form an electrical wire connection. Teeth are on a bottom surface of the electrical wire connection; wherein the teeth obstruct movement of the sheaths. A bolt, is detachably coupled to the body. Silicone fills the cavity with the at least two electrical wires. Tightening the bolt onto the sheaths into the teeth displaces some of the silicone from the cavity and creates a watertight compartment for the at least two electrical wires.

In some embodiments, there can be female threads on the body and bolt threads on the bolt. Coupling the bolt threads to the female threads joins the bolt to the body. The female threads and the bolt threads can have a thread size from a set consisting of: 6-32 2A, 6-32 3A, 6-40 2A, 6-40 3A, 8-32 2A, 8-32 3A, 10-24 2A, 20-24 3A, 10-32 2A, and 10-32 3A. In some embodiments, the female threads and the bolt threads have a thread size from a set consisting of: 8-32 2A and 8-32 3A.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
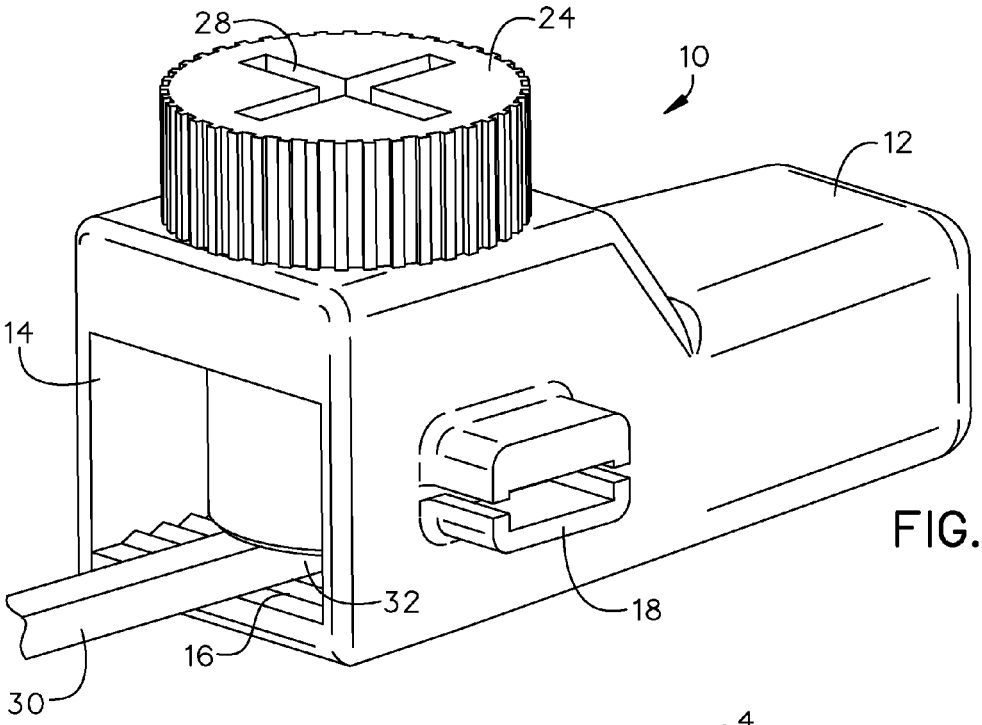
FIG. 1 is a perspective view of an embodiment of the invention shown in use.
Figure 2:
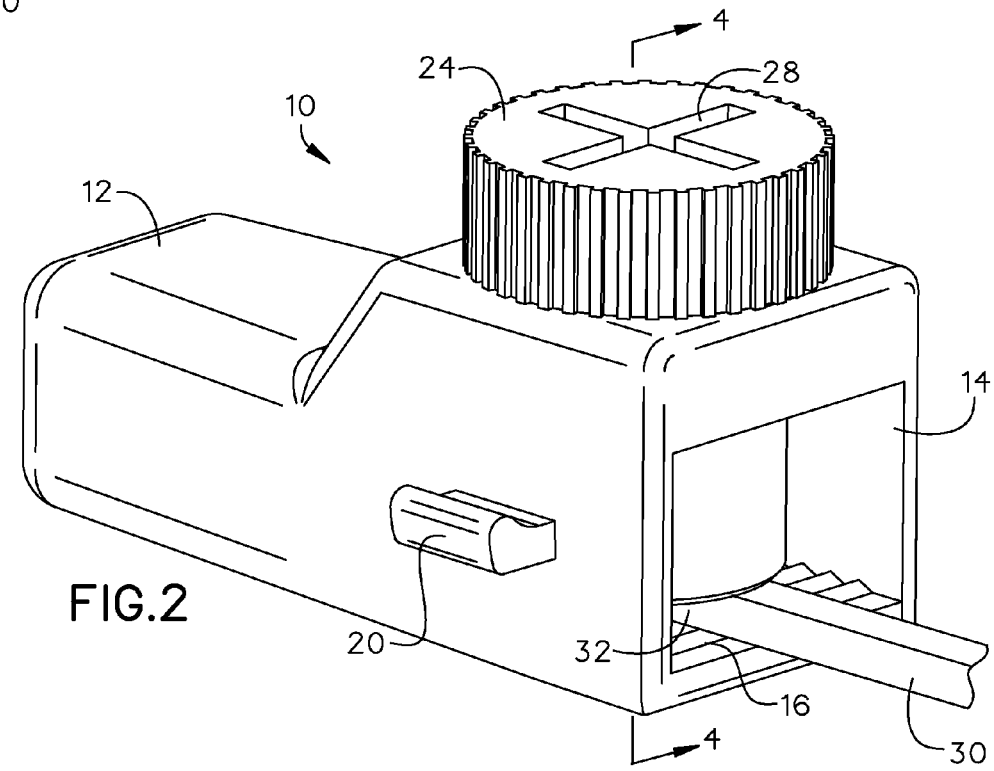
FIG. 2 is a perspective view of an embodiment of the invention shown in use.

By way of example, and referring to FIG. 1 and FIG. 2, one embodiment of electrical wire connector 10 comprises body 12 having cavity 34 which can be accessed by port 14. A bottom surface of body 12 is mechanically coupled to teeth 16. Body 12 is mechanically coupled to side female protrusion 18 and side male protrusion 20. Body 12 is further mechanically coupled to female threads 22.

Figure 3:
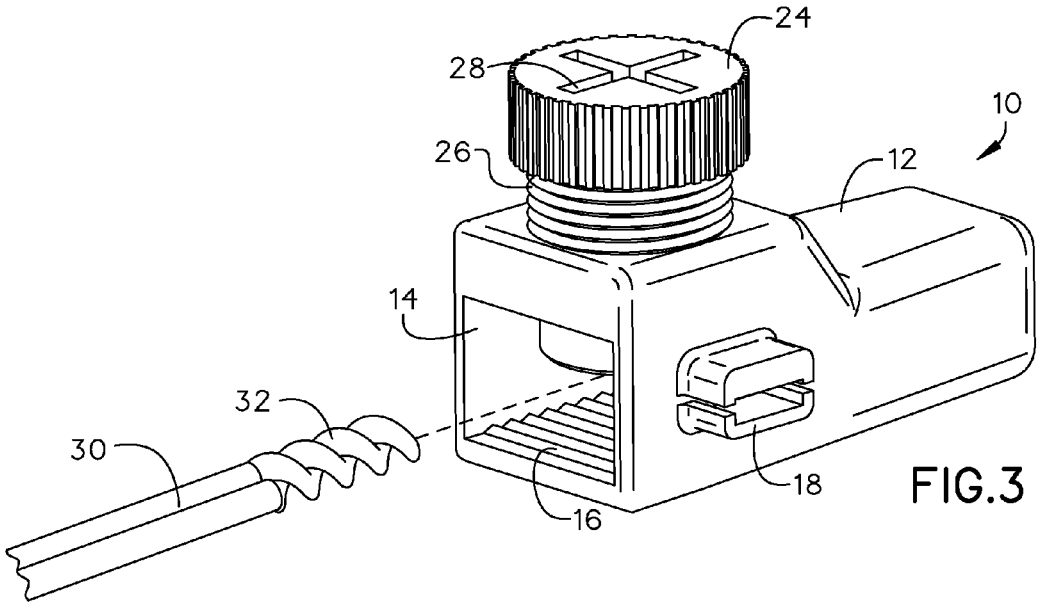
FIG. 3 is an exploded view of an embodiment of the invention.
Figure 4:
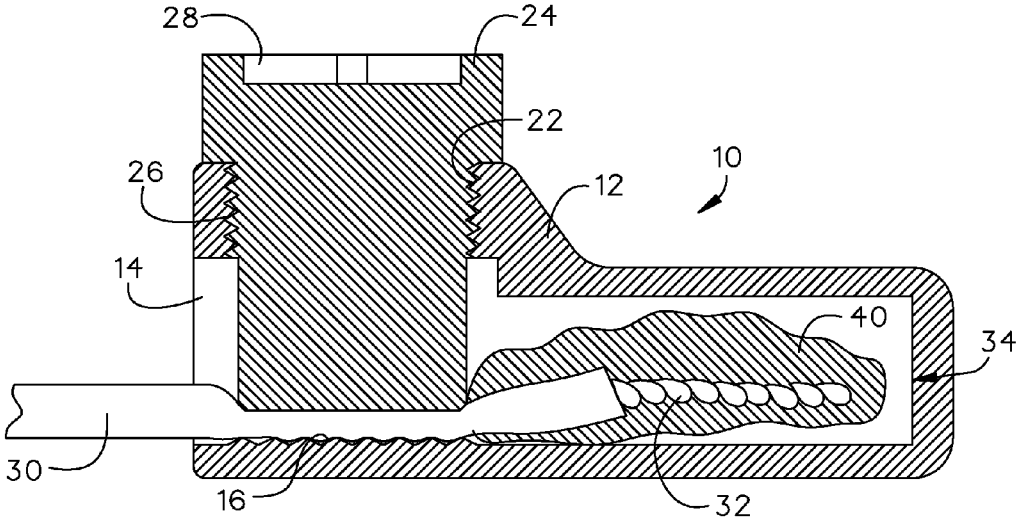
FIG. 4 is a section view of an embodiment of the invention along line 4-4 in FIG. 2.

As shown in FIG. 3 and FIG. 4, bolt 24 is mechanically coupled to bolt threads 26 and bolt heat slot 28. Bolt threads 26 is configured to mate with female threads to join bolt 24 to body 12. Having too small threads creates a firm seal between bolt 24 and body 12 but it takes a long time to mate bolt 24 to body 12. Having to large of threads results in a short mating time, but does not create a firm seal. A balance between these extremes can be found by using a thread size from a set consisting of: 6-32 2A, 6-32 3A, 6-40 2A, 6-40 3A, 8-32 2A, 8-32 3A, 10-24 2A, 20-24 3A, 10-32 2A, and 10-32 3A. ANSI/ASME B1.3M-1992 (R2001) provides ample details on these standard sizes. Of those, 8-32 2A, 8-32 3A were found to be the best in testing. This offers a compromise that works for many users.

A process for joining wires in a waterproof setting involves the following steps, which are not necessarily in order. First, providing electrical wire connector 10 with bolt 24 connected to body 12 where body 12 further comprises cavity 34 behind bolt 24. Next, obtaining at least two electrical wires 32 covered partially in sheaths 30. After that, twisting the at least two electrical wires 32 together. Following that, inserting the at least two electrical wires 32 into the cavity which are twisted to form an electrical wire connection. Then, filling the cavity with silicone 40. In some embodiments, cavity 34 is sold pre-filled with silicone 40. Next, clamping bolt 24 onto sheaths 30 such that the exposed ends of the at least two electrical wires 32 are entirely in cavity 34 and covered in silicone 40. Following that, displacing at least some of silicone 40 with bolt 24. This creates a watertight compartment for the electrical wire connection.

Figure 5:
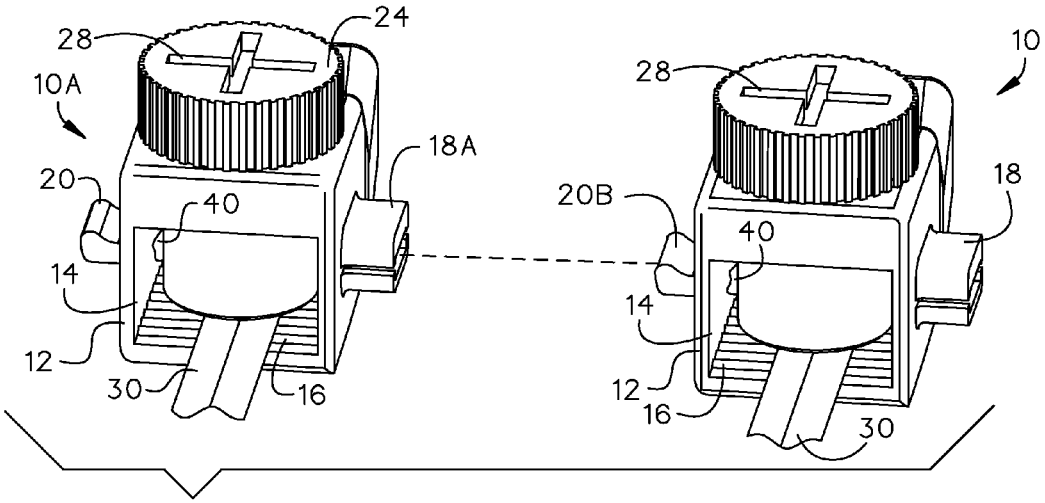
FIG. 5 is an exploded view of an embodiment of the invention.
Figure 6:
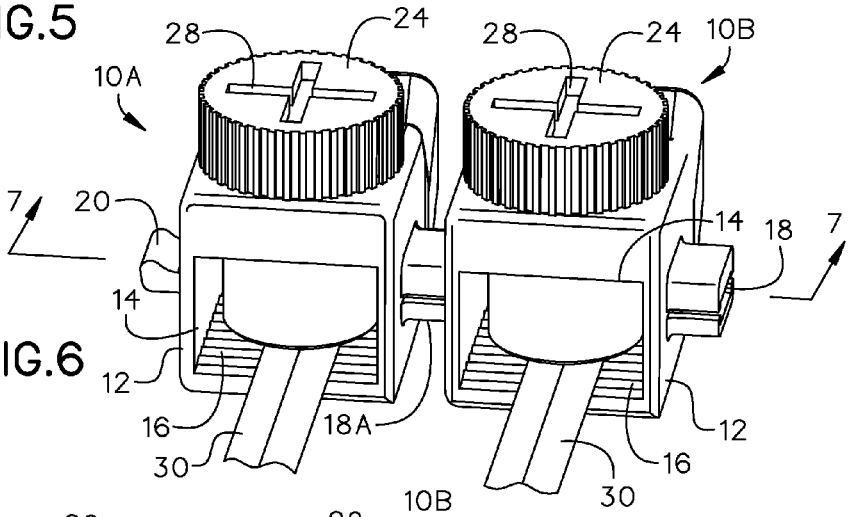
FIG. 6 is a perspective view of an embodiment of the invention.
Figure 7:
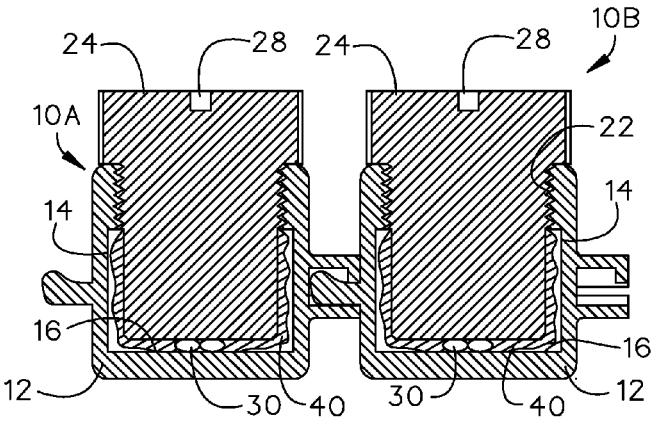
FIG. 7 is a section detail view of an embodiment of the invention.

Turning to FIG. 5, FIG. 6, FIG. 7, one advantage of the present construction is that a series of electrical wire connectors 10 can be joined in sequence. First wire connector 10A is mechanically coupled to first female protrusion 18A. Second wire connector 10B is mechanically coupled to second male protrusion 20B. A user can slide second male protrusion 20B into first female protrusion 18A to detachably couple First wire connector 10A to second wire connector 10B.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An electrical wire connector, configured to secure at least two electrical wires partially covered in sheaths; the electrical wire connector comprising:

a body further comprising a cavity entirely enclosed and only accessible through a port at one end;

teeth, fixed to a bottom surface of the electrical wire connection; wherein the teeth obstruct movement of the sheaths;

a bolt, detachably coupled to the body; wherein the port is configured to receive the at least two electrical wires twisted to form an electrical wire connection distant the sheaths, the bolt and the teeth;

a female side protrusion attached to a first side of the body; wherein the female side protrusion is configured to connect to a second body male side protrusion in order to link an electrical wire connector to a second wire connector;

silicone, filling the cavity with the at least two electrical wires;

wherein tightening the bolt onto the sheaths into the teeth displaces some of the silicone from the cavity and creates a watertight compartment for the at least two electrical wires behind the bolt.

2. The electrical wire connector of claim 1, further comprising:

female threads on the body; and bolt threads on the bolt;

wherein coupling the bolt threads to the female threads joins the bolt to the body.

3. The electrical wire connector of claim 2, wherein the female threads and the bolt threads have a thread size from a set consisting of: 6-32 2A, 6-32 3A, 6-40 2A, 6-40 3A, 8-32 2A, 8-32 3A, 10-24 2A, 20-24 3A, 10-32 2A, and 10-32 3A.

4. The electrical wire connector of claim 2, wherein the female threads and the bolt threads have a thread size from a set consisting of: 8-32 2A and 8-32 3A.

5. The electrical wire connector of claim 1, wherein the female side protrusion further comprises an upper shell having an inner cavity proximate a lower concave shell.

6. The electrical wire connector of claim 5, wherein the second body male side protrusion further comprises a parallelepiped base that expands outward into a notch; wherein the fits into the inner cavity connecting the body to a second body.

7. The electrical connector of claim 1, further comprising a channel formed by displacement of the silicone by the insertion of the at least two electrical wires through the port in the cavity.

8. The electrical connector of claim 7, further comprising a watertight seal formed by turning the bolt downward to redirect the silicone into the channel forming the waterproof compartment.

* * * * *